US010160206B2

(12) United States Patent
Chen et al.

(10) Patent No.: US 10,160,206 B2
(45) Date of Patent: Dec. 25, 2018

(54) ACCOUNTING FOR OSCILLATIONS WITH DROP EJECTION WAVEFORMS

(71) Applicant: Hewlett-Packard Development Company, L.P., Houston, TX (US)

(72) Inventors: Zhizhang Chen, Corvallis, OR (US); Tony S. Cruz-Uribe, Independence, CO (US); Peter J. Fricke, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/762,644

(22) PCT Filed: Jan. 31, 2013

(86) PCT No.: PCT/US2013/024103
§ 371 (c)(1),
(2) Date: Jul. 22, 2015

(87) PCT Pub. No.: WO2014/120197
PCT Pub. Date: Aug. 7, 2014

(65) Prior Publication Data
US 2015/0367634 A1 Dec. 24, 2015

(51) Int. Cl.
*B41J 2/045* (2006.01)

(52) U.S. Cl.
CPC ..... *B41J 2/04588* (2013.01); *B41J 2/04508* (2013.01); *B41J 2/04536* (2013.01); *B41J 2/04573* (2013.01); *B41J 2/04581* (2013.01)

(58) Field of Classification Search
CPC ..... B41J 2/04588; B41J 2/04536; B41J 2/04525; B41J 2/04573; B41J 2/04581; B41J 2/04508
See application file for complete search history.

(56) References Cited

U.S. PATENT DOCUMENTS 4,369,455 A 1/1983 McConica et al.
5,461,403 A * 10/1995 Wallace ..... B41J 2/04581 347/10

(Continued)

FOREIGN PATENT DOCUMENTS

EP 1013453 A2 * 6/2000 ..... B41J 2/0451
JP 2005-153378 A 6/2005
JP 2008-173910 A 7/2008

OTHER PUBLICATIONS

KR International Searching Authority, International Search Report & Written Opinion, International Application No. PCT/US2013/024103, dated Oct. 7, 2013, 11 pages.

*Primary Examiner* — Julian Huffman
*Assistant Examiner* — Michael Konczal
(74) *Attorney, Agent, or Firm* — HP Inc.—Patent Department

(57) ABSTRACT

Accounting for oscillations with drop ejection waveforms can include identifying a previous ejection waveform having a first plurality of parameters including a time interval from a final pulse of the previous ejection waveform. Accounting for oscillations with drop ejection waveforms can include determining a second plurality of parameters based on the first plurality of parameters, where the second plurality of parameters define a current ejection waveform that accounts for oscillations caused by the previous ejection waveform. Accounting for oscillations with drop ejection waveforms can include applying the current ejection waveform to cause an ejection nozzle of the printhead to generate a desired fluid drop.

20 Claims, 13 Drawing Sheets

(56) References Cited

U.S. PATENT DOCUMENTS

| | | | | |
|---|---|---|---|---|
| 6,145,949 | A * | 11/2000 | Takahashi | B41J 2/04553 347/11 |
| 6,328,397 | B1 | 12/2001 | Shimizu et al. | |
| 6,375,299 | B1 * | 4/2002 | Foster | B41J 2/0451 347/19 |
| 6,428,134 | B1 * | 8/2002 | Clark | B41J 2/04506 347/10 |
| 6,682,162 | B2 * | 1/2004 | Simons | B41J 2/0451 347/19 |
| 6,910,751 | B2 * | 6/2005 | Groninger | B41J 2/04525 347/12 |
| 6,926,388 | B2 * | 8/2005 | Groninger | B41J 2/04525 347/19 |
| 7,703,893 | B2 * | 4/2010 | Groninger | B41J 2/04555 347/19 |
| 7,866,781 | B2 * | 1/2011 | Kim | B41J 2/0451 347/19 |
| 8,251,471 | B2 | 8/2012 | Fontaine et al. | |
| 8,353,567 | B1 | 1/2013 | Banerjee et al. | |
| 2012/0206532 | A1 * | 8/2012 | Kim | B41J 2/0451 347/19 |

* cited by examiner

ACCOUNTING FOR OSCILLATIONS WITH DROP EJECTION WAVEFORMS

This application is a National Stage Application under 35 U.S.C. § 371 of International Application Number PCT/US2013/024103 filed Jan. 31, 2013 that published as WO2014/120197 on Aug. 7, 2014, the entire contents of which are incorporated herein by reference in its entirety.

BACKGROUND

Printing devices are widely used and may include fluid ejection elements enabling formation of text or images on a print medium. For instance, a piezoelectric printing device may employ membranes that deform when electric energy is applied. The membrane deformation causes ejection of fluid.

DETAILED DESCRIPTION

As printing technology improves, the ability to provide improved features and higher resolution becomes increasingly possible. Consumers may want, among other things, higher levels of image resolution, realistic colors, and an increased printing rate (e.g., pages per minute) from a printhead. Consumers may, for example, include commercial printing owners and/or business staff, among others. However, as the level of resolution and/or the printing rate increases so too do an amount of oscillations and/or a magnitude of the oscillations experienced by the printhead following ejection of fluid (e.g., a drop of ink).

Figure 8:
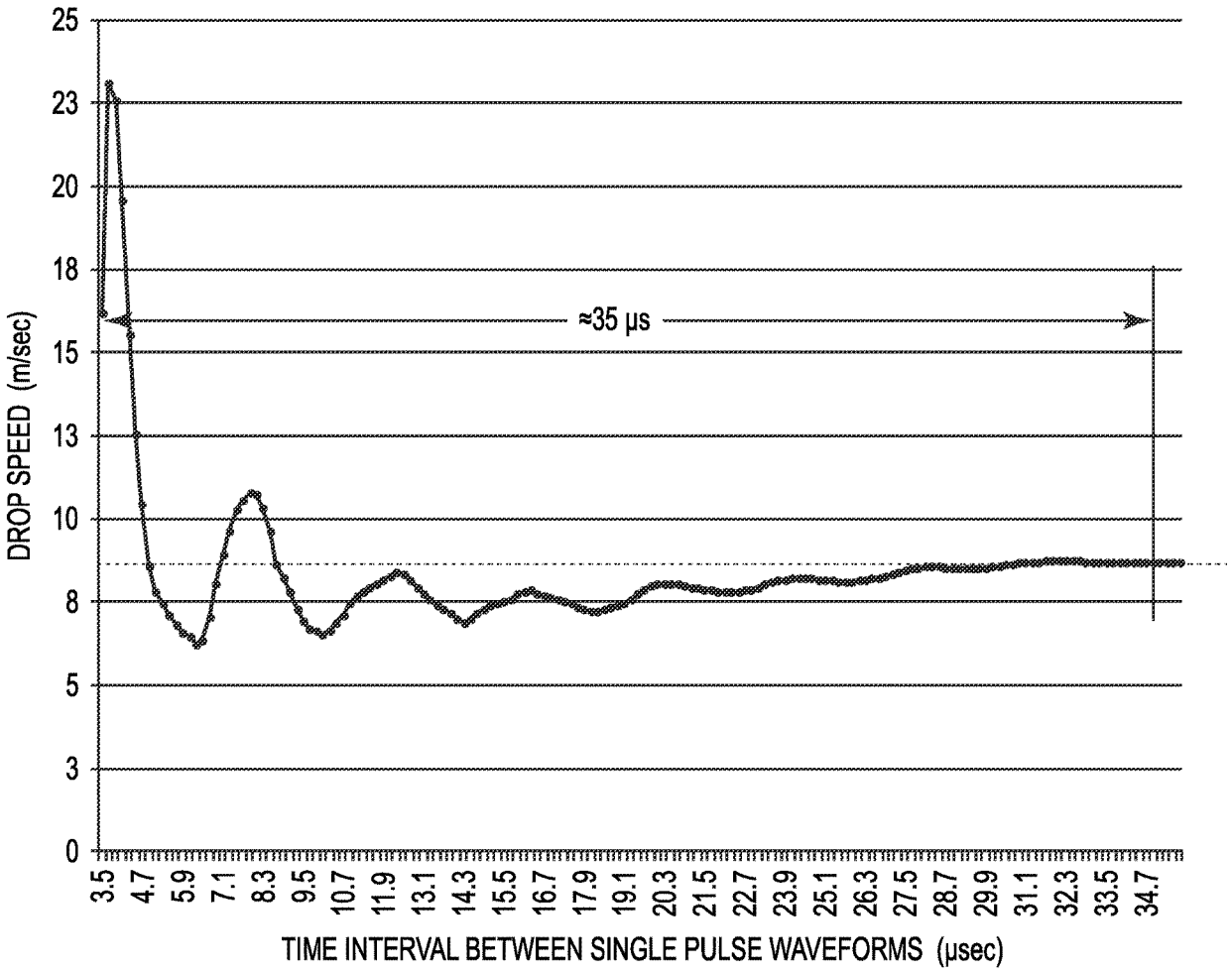
FIG. 8 illustrates a plot of an example drop speed for two example sequential, single-pulse ejection waveforms according to the present disclosure.

As described herein, oscillations refer to pressure fluctuations within a firing chamber of the printhead following ejection of a drop. The oscillations can result in an increase and/or a decrease in a pressure in the chamber. For example, such oscillations may increase or decrease pressure in amounts as large as 10 atmospheres. As illustrated in FIG. 8 and described in herein, generally speaking, the oscillations tend to dissipate (e.g., decrease in magnitude) with time. However, waiting a period of time for such dissipation may be counterproductive to achieving consumer desires, for example, a desire for an increased printing rate and/or a higher resolution. Conversely, printing while experiencing such oscillations can translate to fluctuations in an amount of fluid output (e.g., drop volume) and/or rate of fluid output (e.g., drop speed) from fluid ejection elements (e.g., fluid ejection elements of the printhead). As such, effective control of a printhead may beneficially be implemented in an effort to control such oscillations, for example, oscillations following an output (e.g., ejection) of fluid from the fluid ejection devices. That is, achieving and/or maintaining increased levels of resolution and/or an increased printing rate can depend upon on an ability to effectively control the oscillations experienced by the fluid ejection elements of the printhead.

Some previous approaches attempting to provide reliable and/or efficient control may have relied upon allowing oscillations to dissipate with time, passive dampening (e.g., printhead cavities that increase viscous losses or compliantly absorb pressure waves to reduce oscillations), and/or employing active dampening (e.g., a non-ejection waveform emitted in an effort counter oscillations). Each of these approaches has limitations such as decreasing the maximum printing rate and/or increasing the energy needed to operate the fluid ejection devices. Some other previous approaches may have included calibration, such as, calibration on individual nozzles to account for differences in fluid volume emitted between various nozzles of a printhead. Calibration improves uniformity of output but does not reduce the effect of oscillations. In contrast to the present disclosure, such previous approaches, alone or in combination, do not account for the oscillations and/or do not account for the oscillations experienced over a range of printing frequencies, as described herein.

In contrast, examples of the present disclosure include methods, systems, drive circuits, and computer-readable and executable instructions for accounting for oscillations with drop ejection waveforms. Accounting for oscillations refers to identifying a previous ejection waveform having a first plurality of parameters including a time interval from a final pulse of the previous ejection waveform and/or determining (e.g., varying) a second plurality of parameters based on the identified first plurality of parameters. The second plurality of parameters can define the current ejection waveform that accounts for oscillations caused by the previous ejection waveform. In various examples, the second plurality of parameters can be applied to an ejection nozzle (e.g., to a piezoelectric actuator of an ejection nozzle), as described herein, to cause the ejection nozzle to generate a desired drop (e.g., having a desired drop volume (DV) and/or a desired drop speed (DS)). As described herein, an ejection waveform refers to a waveform that can be applied to an ejection nozzle to cause the ejection nozzle to generate a fluid drop (e.g., a desired ink drop).

The second plurality of parameters can be varied (e.g., incrementally varied) to experimentally determine a particular combination of the second plurality of parameters that can effectively account for oscillations caused by a particular combination of the first plurality of parameters. In some examples, the second plurality of parameters can be varied to modulate DV to the desired DV while maintaining DS (e.g., an undesired DS). Conversely, in some examples, DS can be modulated while maintaining DV or both DS and DV can be simultaneously modulated. Accounting for oscillations (e.g., printhead oscillations) with drop ejection waveforms can promote reliable and/or efficient control of the printheads across a wide range of printing frequencies. As described herein, printing frequency refers to a measure of a speed at which printing can occur (i.e., a rate at which a number of pixel locations on a given media pass by the printhead).

In various examples, a previous ejection waveform can be identified. A previous ejection waveform refers to an ejection waveform that was initiated (e.g., pulses of the previous ejection waveform were emitted) prior to a given time and/or time period. In various examples, the previous ejection waveform can have a first plurality of parameters, for example, a time interval from a final pulse of the previous ejection waveform, a drive voltage parameter, a pulse width parameter, among others as described herein.

In various examples, a second plurality of parameters based on the first plurality of parameters can be determined. In various examples, the second plurality of parameters can define a current ejection waveform that can account for oscillations caused by the previous ejection waveform. A current ejection waveform refers to a waveform that is initiated (e.g., pulses of the current ejection waveform are generated and/or applied) at a current time and/or during a current time period. For example, a current ejection waveform can include multiple ejection pulses occurring over a period of time. In various examples, the current ejection waveform can be applied to cause an ejection nozzle of the printhead to generate a desired fluid drop. A desired fluid drop refers to a fluid drop having a desired DV and/or a desired DS.

In the following detailed description of the present disclosure, reference is made to the accompanying drawings that form a part hereof, and in which is shown by way of illustration how examples of the present disclosure can be practiced. These examples are described in sufficient detail to enable those of ordinary skill in the art to practice the examples of this disclosure, and it is to be understood that other examples can be utilized and that process, electrical, and/or structural changes can be made without departing from the scope of the present disclosure.

As will be appreciated, elements shown in the various examples herein can be added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense. As used herein, "a number of" an element and/or feature can refer to one or more of such elements and/or features. In addition, "for example" and similar phrasing is intended to mean, "by way of example and not by way of limitation".

Examples of the present disclosure, therefore, will be described in reference to a piezoelectric ejector structure. Examples, however, are not limited to such structures, but may be implemented in other structures such as electrostatic inkjet structures, among others.

Figure 1:
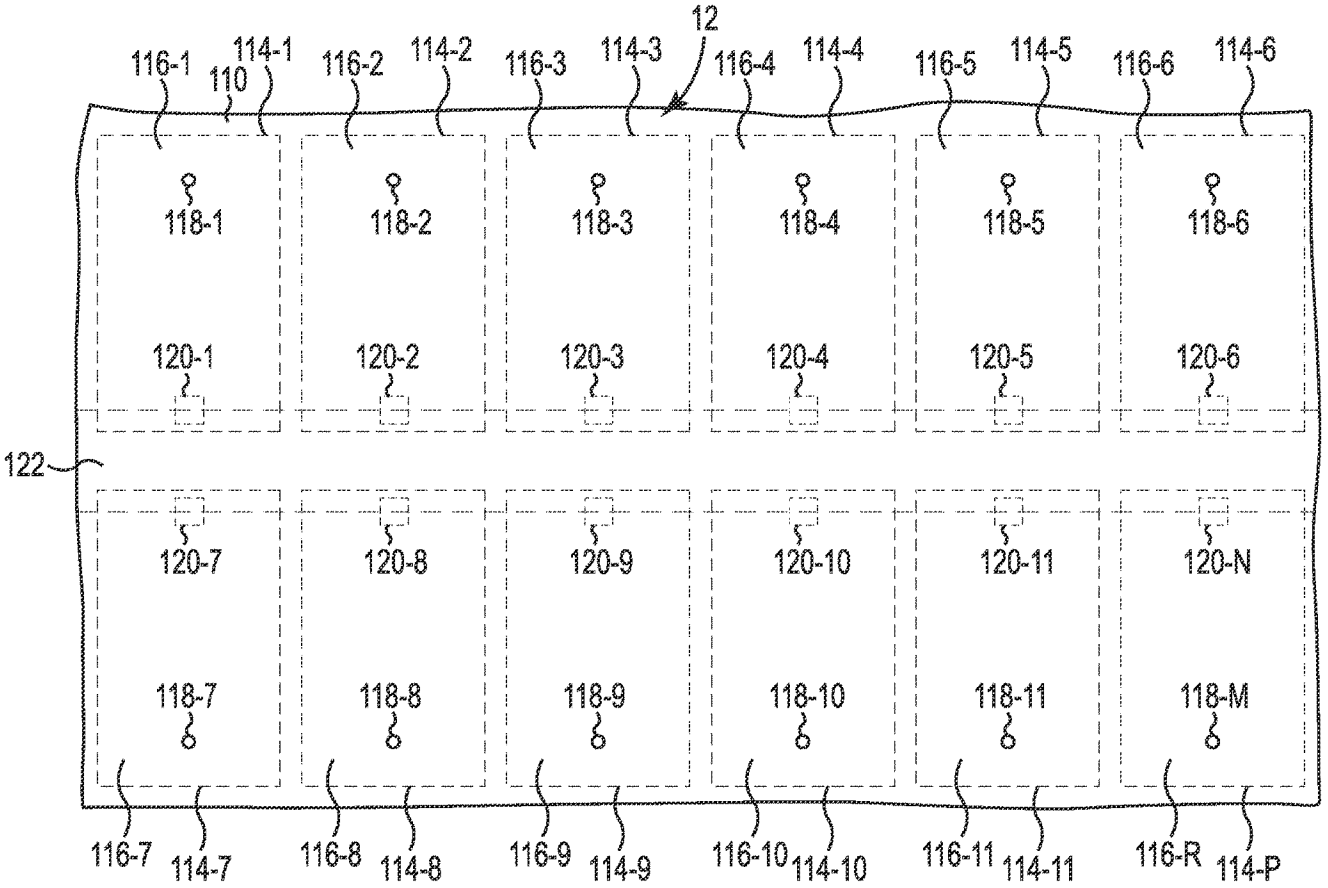
FIG. 1 is a plan view illustrating a portion of an example of a piezoelectric inkjet printhead that includes an array of individual fluid ejector structures having oscillations according to the present disclosure.

FIG. 1 is a plan view illustrating a portion of one example of a piezoelectric inkjet printhead 110 that includes an array 112 of individual fluid ejector structures 114-1, . . . , 114-P. For a piezoelectric inkjet printhead 110, the fluid (ink) dispensed with ejector structures 114-1, . . . , 114-P is a liquid, although a small amount of gas, typically air bubbles, may sometimes be present in the fluid (e.g., ink). The piezoelectric inkjet printhead 110 may eject pigment based ink, dye-based ink, another type of ink, or another type of fluid. Examples of other types of fluid include those having water-based or aqueous solvents, as well as those having non-water-based or non-aqueous solvents, among other fluids. The examples described herein can thus pertain to a suitable type of fluid-ejection precision dispensing device that dispenses a substantially liquid fluid.

Referring to FIG. 1, each ejector structure 114-1, . . . , 114-P includes a firing chamber (e.g., firing chamber 116-1), a fluid ejection orifice (e.g., fluid ejection orifice 118-1) and a fluid inlet (e.g., fluid inlet 120-1). Fluid inlets 120-1, . . . , 120-N can be coupled to a fluid channel 122 that supplies fluid to firing chambers 116-1, . . . , 116-R from a fluid source (not shown). In the portion of the piezoelectric inkjet printhead 110 shown in FIG. 1, ejector structures 114-1, . . . , 114-P are laid out in two columns that can each be supplied by a single fluid channel 122. The columns can, in some examples, include an offset from each other such that nozzles in each respective column can offset from one another. However, the disclosure is not so limited. That is, the rows and/or columns can be arranged to provide a native resolution and/or provide redundancy for failsafe operation. A piezoelectric inkjet printhead 110 may include hundreds of individual ejector structures 114-1, . . . , 114-P arrayed in several columns and/or rows fed by multiple fluid supply channels (e.g., fluid channel 122).

Figure 2A:
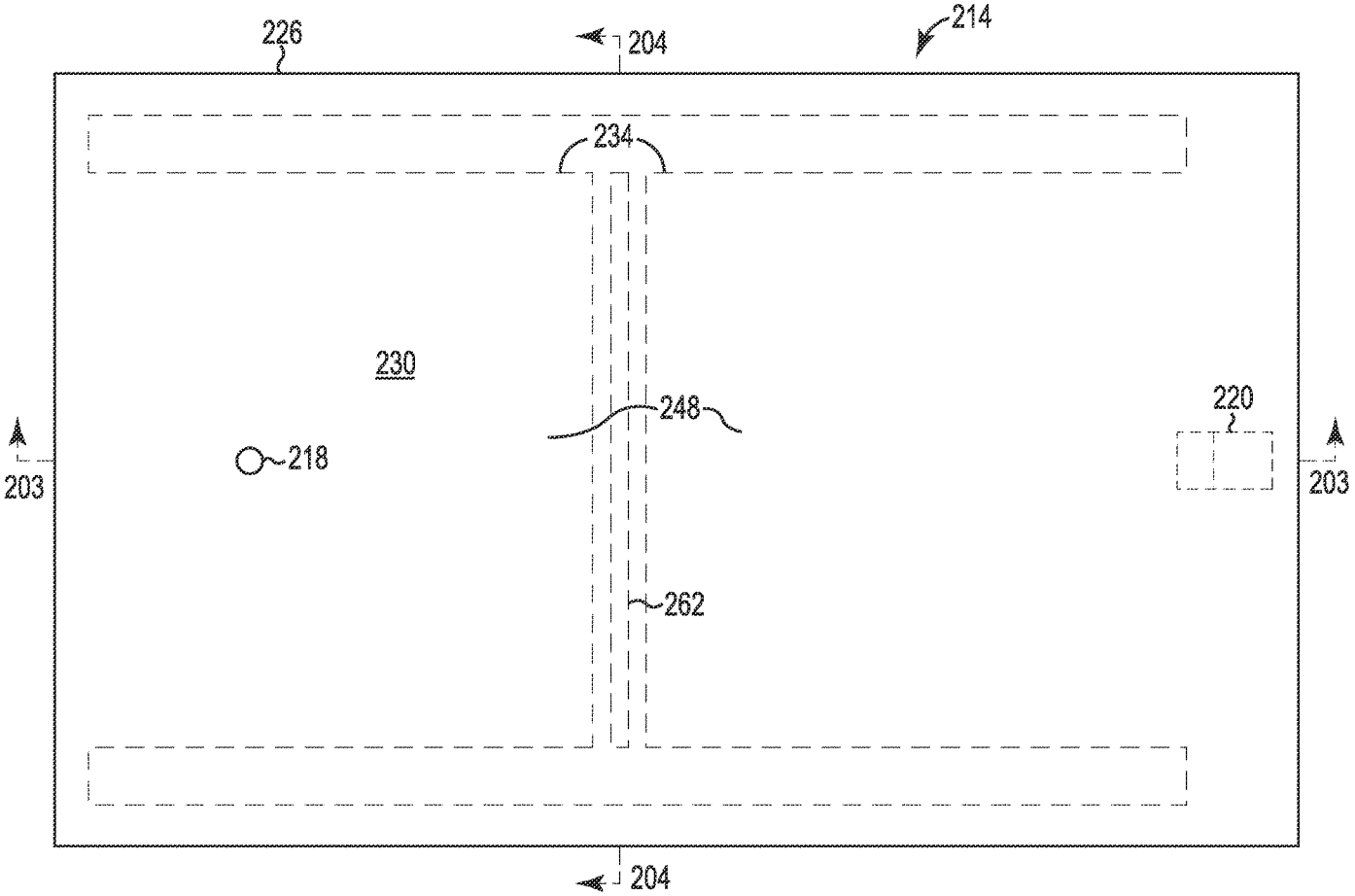
FIG. 2A is a plan view of an example of a piezoelectric ejector structure according to the present disclosure.
Figure 2B:
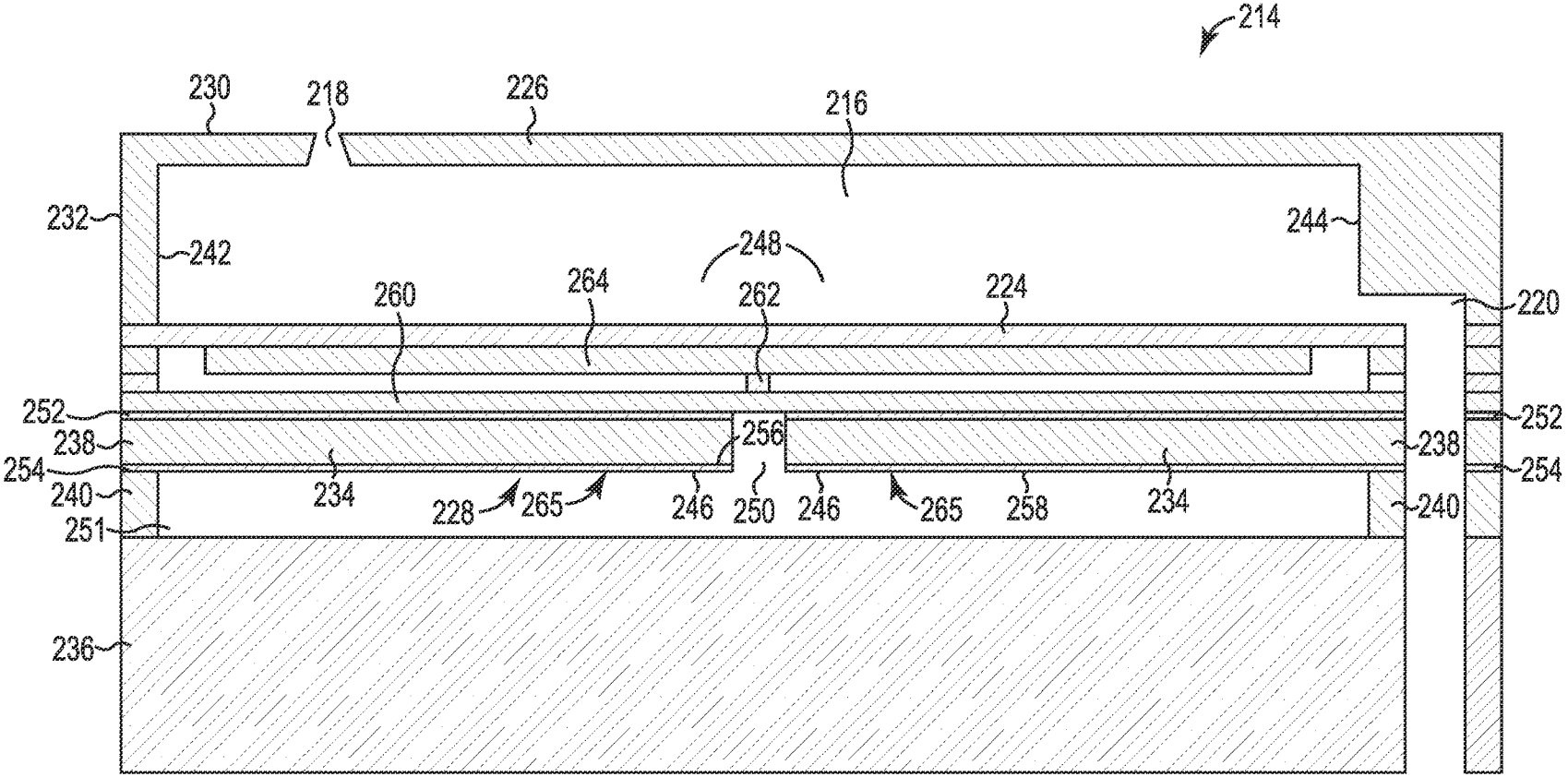
FIG. 2B is an elevation section view of an example of a piezoelectric ejector structure according to the present disclosure illustrating a lengthwise section taken along the line 203-203 in FIG. 2A.
Figure 2C:
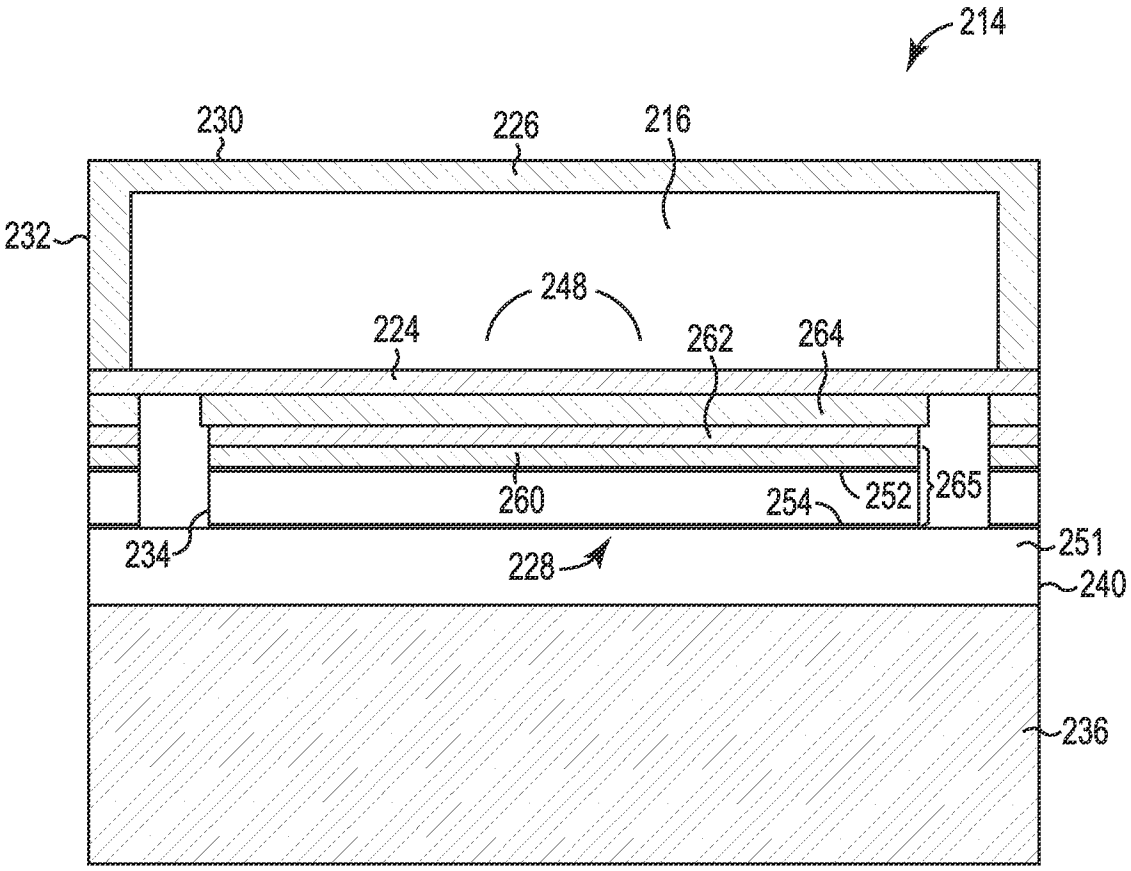
FIG. 2C is an elevation section view of an example of a piezoelectric ejector structure according to the present disclosure illustrating a crosswise section taken along the line 204-204 in FIG. 2A.

FIG. 2A is a plan view illustrating one example of an individual piezoelectric ejector structure (e.g., ejector structure 114-1). FIG. 2B is an elevation section view of an example of a piezoelectric ejector structure according to the present disclosure illustrating a lengthwise section taken along the line 203-203 in FIG. 2A. FIG. 2C is an elevation section view of an example of a piezoelectric ejector structure according to the present disclosure illustrating a crosswise section taken along the line 204-204 in FIG. 2A.

Referring to FIGS. 2A, 2B, and 2C ejector structure 214 includes a firing chamber 216, a fluid ejection orifice 218 through which fluid drops can be ejected from the firing chamber, and an inlet 220 through which fluid may enter the chamber, for example from an inlet supply channel 220. The firing chamber 216 is defined by a flexible membrane 224 and a comparatively rigid cap 226 glued or otherwise affixed to the flexible membrane 224. As described in more detail below, a piezoelectric actuator 228 coupled to the flexible membrane 224 flexes the flexible membrane to alternately contract and expand the firing chamber 216. "Flexible" and "rigid" as used herein are relative terms whose characteristics are determined in the context of the scale of deformation and movement in the piezoelectric actuator 228 and in membrane 224.

During contraction, the pressure in the firing chamber 216 increases and fluid is expelled from the firing chamber through the fluid ejection orifice 218. During expansion, the pressure in the firing chamber 216 decreases and fluid refills the firing chamber through the inlet supply channel 220. The oscillations can be formed, for example, as a result of expansion and/or contraction of the flexible membrane 224 for the ejector structures (e.g., the ejector structure 214).

The ejection orifices (e.g., the ejection orifice 218) can be formed in an exposed face 230 of a cap 226. The cap 226, which is can be referred to as an "orifice plate" or a "nozzle plate," can be formed in a silicon or metal sheet, although other suitable materials or configurations may be used. The flexible membrane 224 may be formed, for example, on the underlying structure as a comparatively thin oxide layer. As an alternative to the "face shooter" shown in FIGS. 1, 2A, 2B, and 2C, in which the ejection orifices 118-1, . . . , 118-M can be formed in the face 230 of the cap 226, a so-called "edge shooter" can be used in which fluid ejection orifices (e.g., the ejection orifice 218) can be formed in an exposed edge 232 of the cap 226. Also, although the elements of a single ejector structure 214 are shown and described in detail, the components of many such ejector structures (e.g., the ejector structures 114-1, . . . , 114-P as illustrated in FIG. 1) can be typically formed simultaneously on a single wafer or on continuous sheets of substrate materials, along with the associated drive and control circuitry, and individual printhead dies (e.g., the piezoelectric inkjet printhead 110) subsequently cut or otherwise singulated from the wafer or sheets. Other techniques (e.g., lamination and/or etching, among others) may be used to make and assemble printhead ejector structures 114-1, . . . , 114-P.

Figure 3:
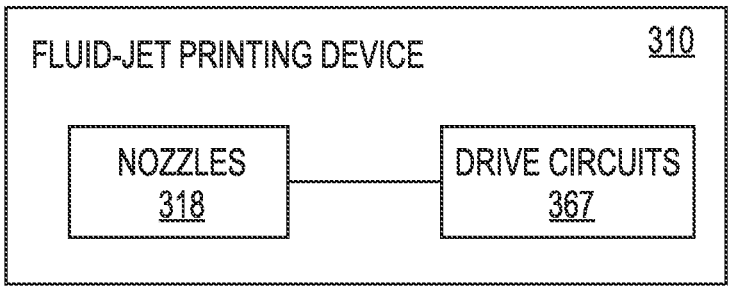
FIG. 3 illustrates a block diagram of an example rudimentary fluid-jet printing device according to the present disclosure.

With continued reference to FIGS. 2A, 2B, and 2C, the piezoelectric actuator 228 includes a pair of cantilever piezoelectric plates 234 formed over a silicon or other suitable substrate 236. The piezoelectric plates 234 can be formed with a piezoelectric ceramic or other suitable piezoelectric material. A fixed end 238 of each of the piezoelectric plates 234 is supported on a wall 240 formed on the substrate 236 along each end (e.g., 242 and 244) of the firing chamber 216. Free ends 246 of each of the piezoelectric plates 234 extends lengthwise to a center part 248 of the firing chamber 216, leaving a gap 250 between the free ends 246 and a gap 251 between each of the piezoelectric plates 234 and the substrate 236. Metal or other suitable conductors 252 and 254 can be formed on the opposing faces 256 and 258 of the piezoelectric plates 234. The conductors 252 and 254, which can be referred to as electrodes, carry the electrical signals that induce the desired deformation in the piezoelectric material in the piezoelectric plates 234. The conductors 252 and 254 can be coupled to a drive circuit (e.g., 367 as illustrated in FIG. 3).

The piezoelectric plates 234 can be coupled to the flexible membrane 224 through a flexible backing 260, a rigid elongate post 262, and a rigid pusher plate 264. For clarity, piezoelectric plates 234 and the rigid elongate post 262 are shown in the plan view of FIG. 2A while some other elements are omitted. The flexible backing 260 covers the piezoelectric plates 234 and spans gap 250 to form a pair of unimorph, bending piezoelectric cantilevers 265 operatively coupled together through a shared inactive layer (e.g., the flexible backing 260). A unimorph is a cantilever that includes one active layer and one inactive layer, the piezoelectric plates 234 and the flexible backing 260, respectively, in the example shown. The deformation of the piezoelectric plates 234 induced by the application of an electric field can result in a bending displacement of the cantilevers 265. Thus, the flexible backing 260 is glued or otherwise operatively connected to the piezoelectric plates 234 to cause the cantilevers 265 to bend when the piezoelectric plates 234 expand or contract lengthwise. In the example shown, the flexible backing 260 can transmit this bending motion to the rigid elongate post 262 at the gap 250. The conductors 252, 254 can be held at different electric potentials from one another and the flexible backing 260 can be formed from a dielectric material.

A single rigid elongate post 262 interposed between the flexible backing 260 and pusher plate 264 extends laterally across the chamber 216 at the free ends 246 of cantilever piezoelectric plates 234 such that the rigid elongate post 262 transmits the movement of piezoelectric plates 234 toward the firing chamber 216 to a rigid pusher plate 264 along a line extending laterally across the firing chamber 216. For the cantilever plates 234, the greatest displacement occurs at the free ends 246. The single rigid elongate post 262 can be positioned along the free ends 246 and therefore may be used to receive and transmit maximum displacement from both of the piezoelectric plates 234. The rigid pusher plate 264 transmits the movement and distributes the lifting force of the rigid elongate post 262 across the flexible membrane 224 in a rigid, or near rigid, piston-like manner that can help increase the displacement of the piezoelectric plates 234 into the firing chamber 216 (e.g., the piezoelectric plates 234 vibrate "up" and "down" to alternately contract and expand a volume of the firing chamber 216).

The present disclosure is not limited to the number and/or orientation of the elements depicted in FIGS. 1, 2A, 2B, and 2C. That is, other configurations including a suitable number, type, and/or configuration of the ejector structure(s) 114-1, . . . , 114-P and/or the firing chamber(s) 116-1, . . . , 116-R, the piezoelectric actuator 228, and/or the piezoelectric plate(s) 234, post(s) 262, among others, that promote accounting for printhead (e.g., piezoelectric inkjet printheads) oscillations are possible. For instance, in some examples, the piezoelectric actuator 228 can include a single piezoelectric plate (not shown). Alternatively or in addition, in some examples, the piezoelectric actuator 228 can form a wall 240 of the of the firing chamber 216.

FIG. 3 illustrates a block diagram of an example of a rudimentary printing device 310. The printing device 310 (e.g., a piezoelectric inkjet printhead) includes a plurality of ejection nozzles 318, such as those described herein, and corresponding drive circuits 367. Each drive circuit of the drive circuits 367 corresponds to a single nozzle of the plurality of ejection nozzles 318, although each ejection nozzle of the plurality of nozzles 318 may have more than one drive circuit 367. The drive circuits 367 may each be implemented as described herein. The printing device 310 may be an inkjet-printing device, which is a device, such as a printer, that ejects fluid onto media, such as paper, to form images, which can include text, on the media.

The printing device 310 can be coupled to a memory storing a lookup table. That is, in some examples, the lookup table can be in communication with the printhead, for example, via a network (e.g., a local area network, etc.) and/or the lookup table can be disposed on the printhead 310.

The lookup table refers to a set of data for a plurality of waveforms (e.g., previous ejection waveforms and/or current ejection waveforms). For instance, the set of data including a first plurality of parameters of a previous ejection waveform and a corresponding set of data including a second plurality of parameters of current ejection waveforms, among others. That is, such data can correspond to the first plurality of parameters and/or the second plurality of parameters can promote accounting for oscillations in printheads caused by the previous ejection waveform. For instance, in some examples, a second plurality of parameters defining a current ejection waveform that accounts for oscillations caused by a previous ejection waveform can be determined from the lookup table (e.g., from the lookup table data). Such a determined second plurality of parameters (e.g., a current ejection waveform defined by the second plurality of parameters) can be applied to cause an ejection nozzle of the printhead to generate a desired fluid drop.

The corresponding set of data including a second plurality of parameters of a current ejection waveforms can be determined (e.g., experimentally determined) to include a second plurality of parameters that can define a current ejection waveform that accounts for oscillations caused by the previous ejection waveform. For example, the data can be a function (e.g., a response function) derived (e.g., graphically determined from the experimentally measured impact on jetted drops). More specifically, a correlation for each of the second plurality of parameters can be determined (e.g., a correlation between a voltage parameter and drop speed). Such determination of a correlation can result in a scaling factor (e.g., 0.85 volts per meter/second) being applied (e.g., to a current ejection waveform and/or a parameter of the second plurality of parameters) to generate a current ejection waveform that can be applied to an ejection nozzle of the printhead to generate a desired drop. That is, such application can combine and/or superpose pressure oscillations associated with the current ejection waveform with residual oscillations (e.g., oscillations caused by the previous ejection waveform).

Figure 9:
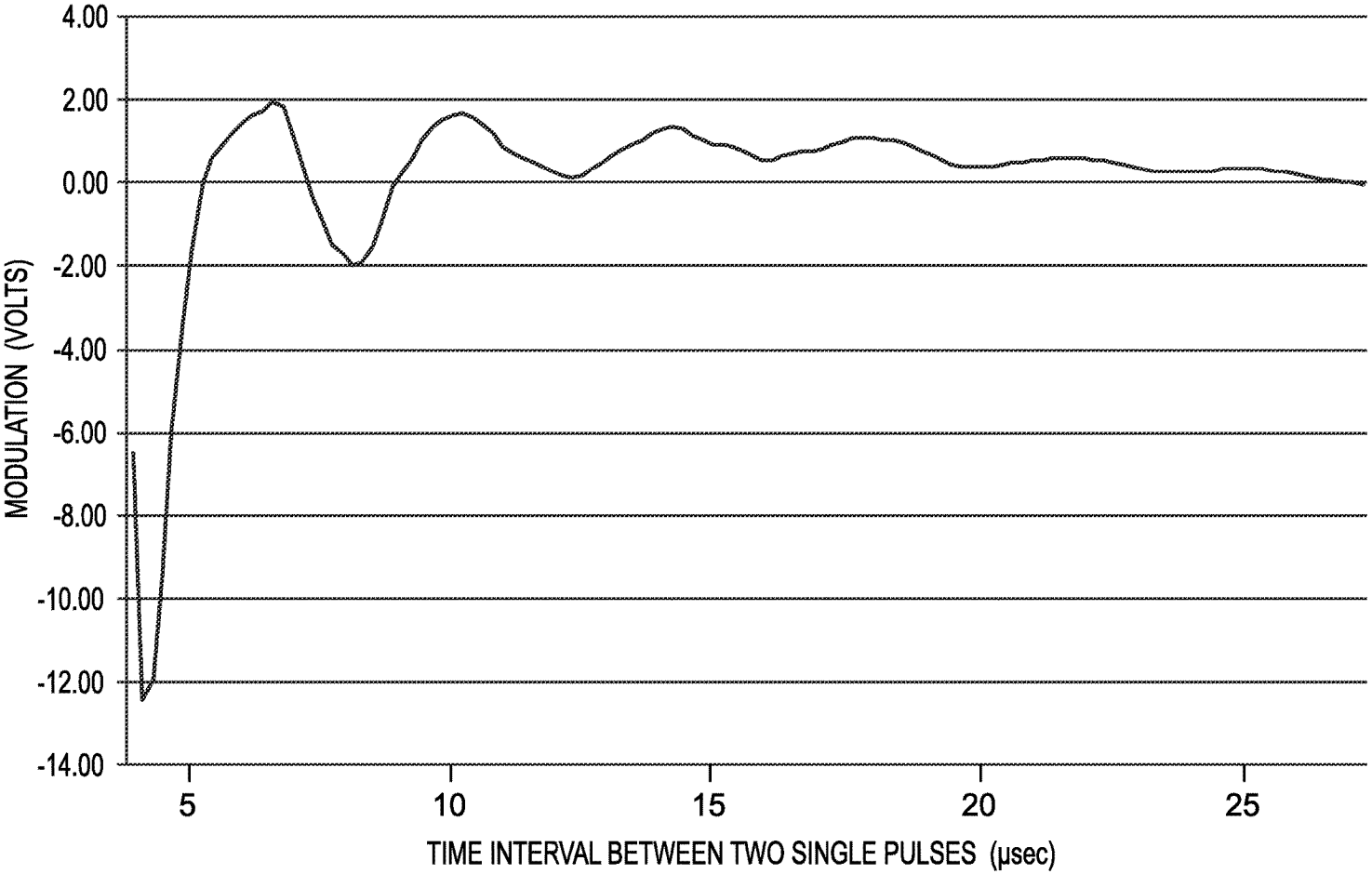
FIG. 9 illustrates a plot of example modulation voltages for an example desired drop speed for an example time interval according to the present disclosure.

That is, such a determined correlation can be used to increase and/or decrease a given parameter of the second plurality of parameters, for example, as described herein with respect to FIG. 9. Whether to comparatively increase or decrease can be a function of a several considerations including the desired drop (e.g., a desired DS and/or DV), the time interval from the final pulse, the time interval between each of the pulses of the previous ejection waveform, and/or a voltage of the each of the final pulses (e.g., the last pulse of the previous ejection waveform). The time interval from the final pulse refers to a time interval spanning from an end of the final pulse of the previous ejection waveform to initiation (e.g., a time associated with initiation) of a first pulse of a current ejection waveform. In some examples, the time interval from the final pulse and the time interval between each of the pulses can be combined to form a time interval. In some examples, the time interval from the final pulse of the plurality of pulses can include a time interval from the start of a first pulse of the previous ejection waveform to an end of the final pulse of the previous ejection waveform. Such a time interval can be a function of the previous ejection waveform width and/or time period between pulses (e.g., pixels printed), among others. The period can be determined by printing speed and a given resolution (i.e., pixel locations per inch on the medium).

Given sufficient time (e.g., a time interval from the final pulse of the previous ejection waveform having a sufficiently long duration) an amount of adjustment (e.g., an adjustment to account for the oscillations) may effectively approach zero (e.g., dissipate). However, for the purposes of the present disclosure, such dissipation can be accounted for by use of a time interval (e.g., a time interval from an end of the final pulse), as described herein, to promote varying a second plurality of parameters to account for the oscillations, rather than letting oscillations dissipate after a given amount of time (e.g., 35 microseconds).

In some examples, the first plurality of parameters and/or the second plurality of parameters can be superposed on trimming compensation (e.g., trimming compensation can, for example, correspond to an amount (e.g., a difference) of the DS or DV from a mean of the DS or DV measured for a plurality of ejection nozzles of the printhead and/or with reference to a performance standard. The amount of such trimming compensation can be measured and/or stored in memory, for example, at a production factory. In some examples, the first plurality of parameters and/or the second plurality of parameters can be superposed on such trimming compensation. For example, a trimming compensation can provide a voltage parameter compensation of an addition of 0.03 volts for a given ejection nozzle and a parameter of the second plurality of parameters can provide a voltage parameter of 10.05 volts to be applied to the given ejection nozzle. Superposition can include summing the trimming compensation and the parameter of the second plurality of parameters to provide a total compensated parameter for the given nozzle. However, the disclosure is not so limited. That is, superposition can include a suitable approach for superposing trimming compensation on the first plurality of parameters and/or the second plurality of parameters. Such superposition can promote a similar (e.g., equal) response for each nozzle of the plurality of nozzles (e.g., the plurality of nozzles 318).

The first plurality of parameters of a previous ejection waveform and the corresponding second plurality of parameters can, for example, include a number of pulses of a current ejection waveform, a duration (e.g., pulse width) of each of the number of pulses, a voltage of each of the number of pulses, a time interval between each of the number of pulses, a duration of pauses within rises and/or falls in the voltage of each of the number of pulses, slew rates (e.g., slew rates based on the duration of pauses within the rises and/or the falls) for each of the number of pulses, and/or a time interval from the final pulse of the number of pulses (e.g., a time interval to a current time from the final pulse of the number of pulses), among others. A waveform having a given set of corresponding parameters (e.g., a second plurality of parameters) can be determined, as described herein, and applied to cause an ejection nozzle of the printhead to generate a desired drop by (e.g., by accounting for oscillations caused by the previous ejection waveform in the current ejection waveform).

Alternatively or in addition, the set of data (e.g., lookup table data) can promote approximations of the first plurality of parameters and/or the corresponding second plurality of parameters. For a given previous ejection waveform having a first plurality of parameters, an approximated value of the first plurality of parameters may be provided. For instance, a suitable number of the first plurality of parameters can be approximated. For example, a previous ejection waveform having a voltage parameter of a given identified value (e.g., 20.047 volts) can be approximated to a value of the first plurality of parameters in the set of data (e.g., 20.050 volts) having a corresponding parameter included in the second plurality of parameters (e.g., 19.750) to generate a desired drop. That is, the desired drop can have a voltage parameter of approximately 20.000. Such approximation ensures that for a previous waveform having a first plurality of parameters a corresponding value (e.g., corresponding to an approximation of a parameters of the first plurality of parameters) can readily be identified. However, the disclosure is not so limited. For instance, parameters of the first plurality of parameters and/or parameters of the second plurality of parameters can have a given fineness (e.g., round-off) that can depend on an associated memory size, a necessary level of precision, a desired parameter gradation, a number of steps available for the control parameters, and/or by availability of experimental data. That is, a suitable number of the first plurality of parameters and/or the corresponding second plurality of parameters can be approximated in a suitable manner to promote accounting for oscillations with drop ejection waveforms.

Advantageously, compensating for variations in DV and/or DS, for example caused by the oscillations, as described herein, can be efficiently done using a lookup table. The lookup table contains data (e.g., experimental data) for a given data (e.g., a first plurality of parameters) and corresponding data for a second plurality of parameters that can facilitate accounting for oscillations with drop ejection waveforms. That is, in some examples, the lookup table can store data associated with the previous number of pulses associated with a given ejection nozzle. In some examples, the lookup table can be coupled to the plurality of ejection nozzles to supply each ejection nozzle of the plurality of ejection nozzles with data from the lookup table. In addition, the second plurality of parameters in the lookup table can include a printing stop time and/or start time parameters, pulse width parameters, voltage parameters, pulse amplitude parameters, a rise time parameter, a push time parameter, a pull time parameter, a fill pause parameter, a delay (e.g., time delay) from a center dot of the current ejection waveform, and/or a time for a given pulse of the current ejection waveform, among others.

In various examples, a current ejection waveform based on the second plurality of parameters can be generated to account for oscillations caused by the previous ejection waveform. That is, such a current ejection waveform can be applied to cause an ejection nozzle of the printhead to generate a desired fluid drop. As described herein in, to "cause" can include executing instructions stored in memory to directly cause an ejection nozzle to generate a desired fluid drop and/or to communicate data that is processed by another device to cause the ejection nozzle to generate a desired fluid drop (e.g., generate the desired fluid drop using the applied current ejection waveform).

Such application can be provided by the drive circuits 367. The example drive circuits as discussed with respect to FIGS. 4 and 5 can be implemented as part of a printhead (e.g., printhead 310) that includes the plurality of nozzles (e.g., 318 as illustrated in FIG. 3). For instance, the drive circuits 367 may be implemented on a circuit layer of the printhead. As a particular example, the drive circuit 367 may reside as part of a complementary metal-oxide semiconductor (CMOS) layer of the printhead. That is, the current ejection waveform can be applied globally (e.g., a golden waveform) or to individual ejection nozzles, as described herein.

Figure 4:
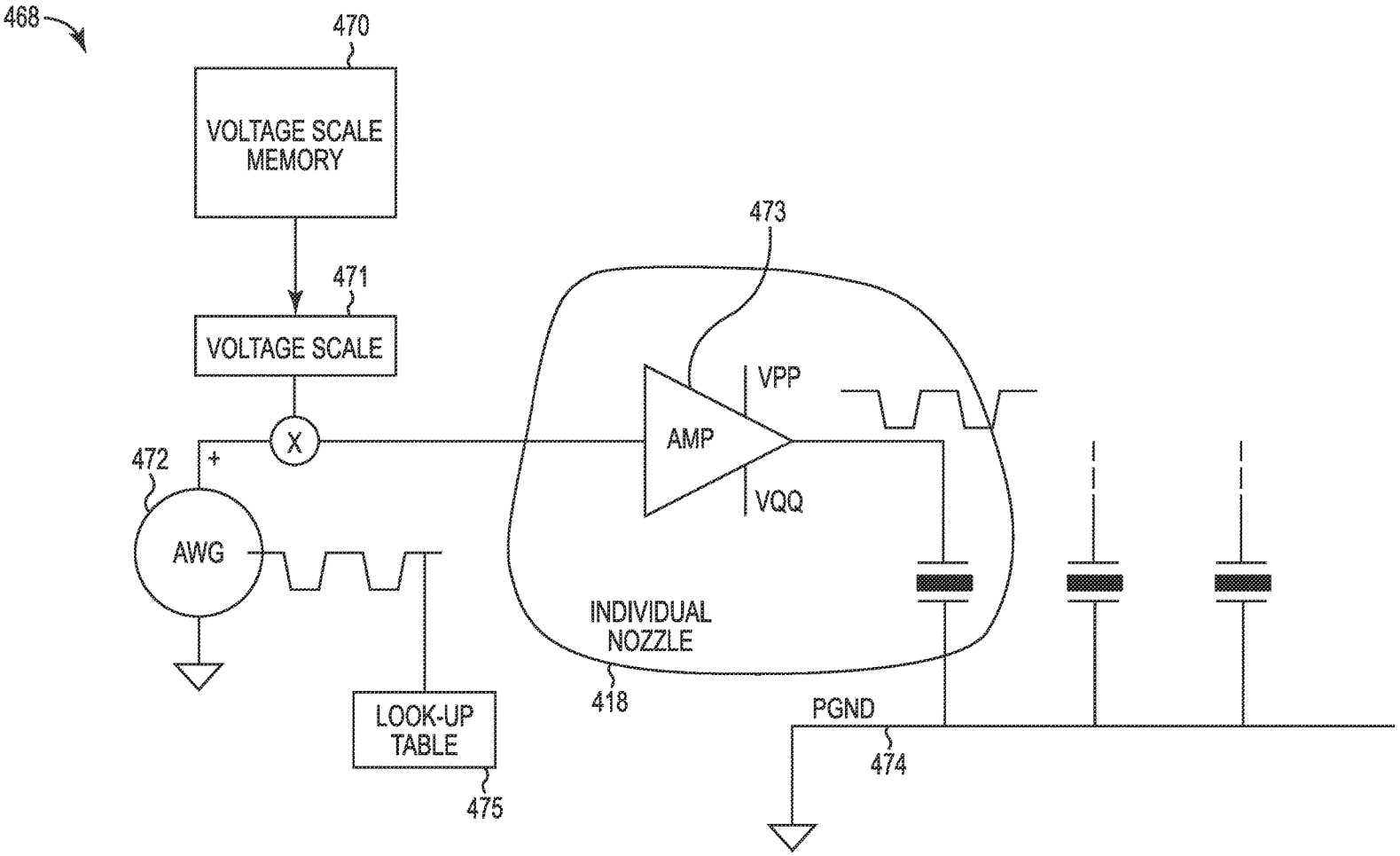
FIG. 4 depicts an example drive circuit for globally applying a current ejection waveform according to the present disclosure.

FIG. 4 depicts an example drive circuit (e.g., a controller) for globally applying a current waveform according to the present disclosure. FIG. 4 illustrates an example drive circuit 468 having an individual ejection nozzle 418 (for ease of illustration additional ejection nozzles are omitted from the FIG. 4), such as those described herein, a voltage scale memory 470, a voltage scale 471, an arbitrary waveform generator (AWG), an amplifier 473, a lookup table 475, and a protective ground (PGND) 474.

The AWG 472 refers to hardware, software, and/or logic to generate an electrical waveform (e.g., the current ejection waveform). Such a waveform can include a number of pulses (e.g., in a range from one pulse to four pulses). Such pulses may be simple (e.g., square shape pulses) or complex (e.g., non-square shaped pulses). The AWG 472 can generate an arbitrarily defined waveform, for example, a waveform stored in the lookup table 475, as an output. The waveform can be defined as a series of "waypoints" specific voltage targets (e.g., specific voltage targets included in the second plurality of parameters stored in the lookup table) occurring at specific times along the waveform and/or the AWG can either jump to those levels or interpolate between those levels. In some examples, the drive circuit can include a digital to analogue converter (DAC)(not shown), for example, provided at an input to AMP 473 to facilitate generation of a given waveform (e.g., a current waveform) via an ejection nozzle coupled to the drive circuit.

In some examples, the lookup table 475 includes a scaling voltage that can be applied to at least one of the plurality of ejection nozzles by multiplying a scaling voltage to the AWG waveform. Hence, in some examples, the voltage scale 471 can be coupled to the AWG in order to scale a waveform therefrom. In some examples, the lookup table 475 includes a scaling voltage that can be applied to at least one of the plurality of ejection nozzles, for example, by utilizing the voltage scale 471 to multiply a scaling voltage to a waveform generated by the AWG 472.

Data representing such a scaling voltage can, in some examples, be stored in the voltage scale memory 470. The voltage scale memory refers to logic and/or hardware to store values (e.g., such as those contained in the lookup table 475) for the ejection nozzle 418. That is, the voltage scale memory can receive the values (e.g., provided by the second plurality of parameters) via a register bus, among other components suitable to provide the stored values. In some examples, the voltage scale memory storage 470 can store pixel data (e.g., pixel data that can be received over time in correspondence with the lookup table 475). The voltage scale memory 470 stores at least a current pixel data for a current pixel in accordance with which the ejection nozzle 418 to eject fluid. The voltage scale memory 470 may be implemented as a combination of logic and/or hardware memory. Such an ability to store values and pixel data can promote the voltage scale memory to account for a wide range of print frequency. Print frequency refers to a frequency (e.g., a rate) at which the pixels pass by a given position of the printhead (e.g., a region of a print medium passes by the given position of the printhead). Scaling of the second plurality of parameters (e.g., a voltage parameter) can promote generation of a desired drop for a given frequency.

As used herein, "logic" is an alternative or additional processing resource to execute the actions and/or functions, etc., described herein, which includes hardware (e.g., various forms of transistor logic, application specific integrated circuits (ASICs), etc.), as opposed to computer executable instructions (e.g., software, firmware, etc.) stored in memory and executable by a processing resource.

The amplifier 473 refers to a suitable device to provide amplification of a signal (e.g., a waveform generated by the AWG), for example, a current ejection waveform. For example, the amplifier 473 can provide amplification based upon the stored data stored at the voltage scale memory 470.

The protective ground (PGND) 474 refers to a suitable device to maintain a printhead (e.g., printhead 310 as illustrated in FIG. 3) at or near earths potential. In some examples, the PGND 474 can be adjusted to provide an adjustable potential (e.g., provided by the second plurality of parameters) to adjust a PGND potential relative too print frequency (not shown). For example, the voltage scale and/or the voltage scale memory can be coupled to the PGND to provide a scaling voltage to the PGND (e.g., to adjust the PGND potential). Adjusting the PGND potential and/or scaling voltage globally (e.g., to multiple ejection nozzles of the plurality of ejection nozzles) and/or individually (e.g., to a single ejection nozzle) can promote control of the printhead and/or promote accounting for oscillations with drop ejection waveforms.

Figure 5:
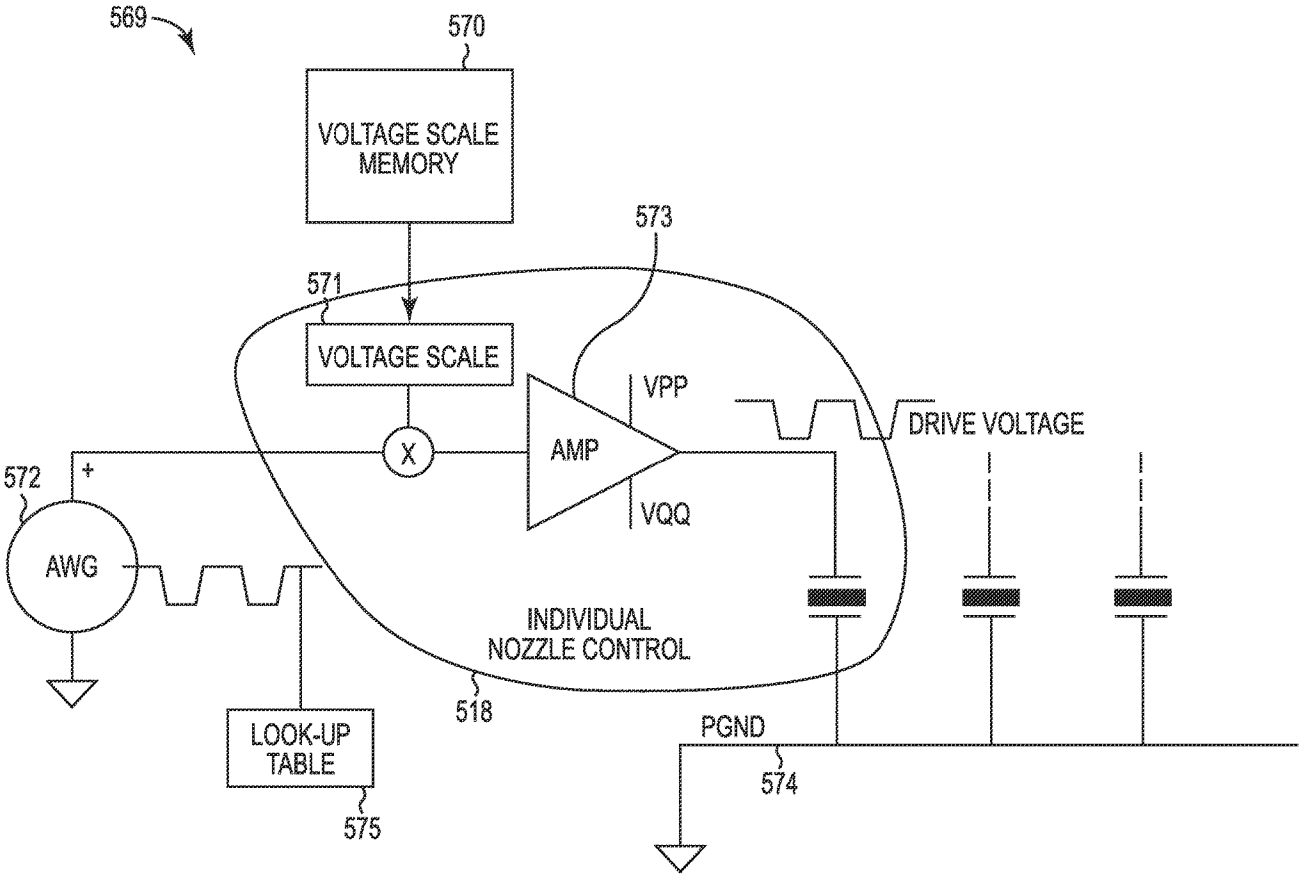
FIG. 5 depicts an example drive circuit for applying a current ejection waveform according to the present disclosure.

FIG. 5 depicts an example drive circuit for individually applying a current ejection waveform according to the present disclosure. FIG. 5 illustrates an example drive circuit 569 having an individual nozzle 518 (For ease of illustration additional nozzles are omitted from FIG. 5), a voltage scale memory 570, a voltage scale 571, an AWG 572, an amplifier, and a PGND 574, are similar and can provide similar functionality to the same described and depicted with respect to FIG. 4. However, the voltage adjustment provided by the stored data from the voltage scale memory 570 and implemented by the voltage scale 571 can be done on a conductor trace corresponding to the individual nozzle 518 rather than globally as depicted in FIG. 4. As described herein, global adjustments refer to an adjustment (e.g., an identical adjustment) being applied to two or more ejection nozzles of the plurality of ejection nozzles (e.g., the plurality of ejection nozzles 318 as illustrated in FIG. 3) of the printhead (e.g., printhead 310). For instance, such an adjustment (e.g., application of a current ejection waveform) to two nozzles can be made in response to the two nozzles experiencing a similar (e.g., same) previous ejection waveform.

Figure 6:
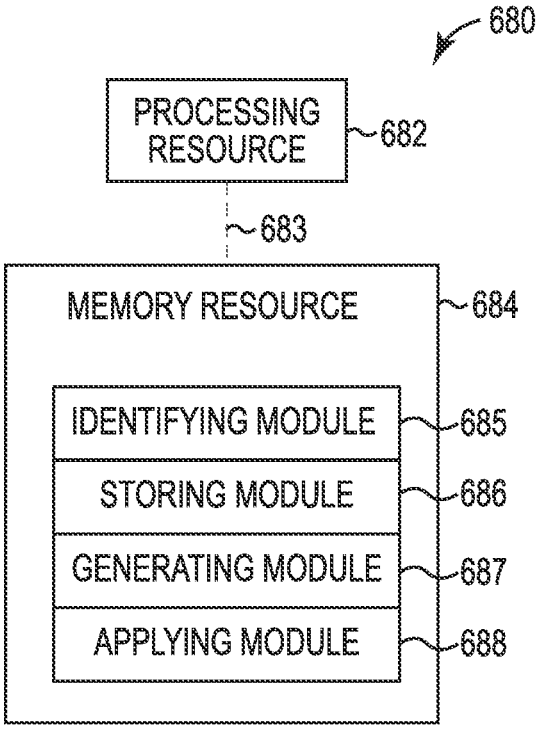
FIG. 6 illustrates a block diagram of an example of a system for accounting for oscillations with drop ejection waveforms according to the present disclosure.

FIG. 6 illustrates a diagram of an example of a system 680 for accounting for oscillations with drop ejection waveforms according to the present disclosure. A system 680 can utilize software, hardware, firmware, and/or logic to perform a number of functions. The system 680 can be a combination of hardware and program instructions to simulate real user issues in support environments. The hardware, for example can include a processing resource 682, a memory resource 684 (e.g., computer-readable medium (CRM)). Processing resource 682, as used herein, can include a number of processing resources capable of executing instructions stored by a memory resource 684. Processing resource 682 may be integrated in a single device or distributed across devices. The program instructions (e.g., computer-readable instructions (CRI)) can include instructions stored on the memory resource 684 and executable by the processing resource 682 to implement a desired function (e.g., apply the current ejection waveform to an ejection nozzle of the printhead to generate a desired fluid drop, etc.).

The memory resource 684 can be in communication with a processing resource 682. A memory resource 684, as used herein, can include a number of memory components capable of storing instructions that can be executed by processing resource 682. Such memory resource 684 can be a non-transitory CRM. Memory resource 684 may be integrated in a single device or distributed across devices. Further, memory resource 684 may be fully or partially integrated in the same device as processing resource 682 or it may be separate but accessible to that device and processing resource 682. The system 680 may be implemented printhead, as described herein.

The processing resource 682 can be in communication with a memory resource 684 storing a set of CRI executable by the processing resource 682, as described herein. The CRI can also be stored in remote memory managed by a server and represent an installation package that can be downloaded, installed, and executed.

Processing resource 682 can execute CRI that can be stored on an internal or external memory resource 684. The processing resource 682 can execute CRI to perform various functions, including the functions described herein. For example, the processing resource 682 can execute CRI to account for oscillations with drop ejection waveforms.

The CRI can include a number of modules 685, 686, 687, 688. The number of modules 685, 686, 687, 688, can include CRI that when executed by the processing resource 682 can perform a number of functions. The number of modules 685, 686, 687, 688 can be sub-modules of other modules. For example, the identify module 685 and the store module 686 can be sub-modules and/or contained within the same computing device. In another example, the number of modules 685, 686, 687, 688 can include individual modules at separate and distinct locations (e.g., CRM, etc.).

In various examples, the system can include an identifying module 685. An identifying module 685 can include CRI that when executed by the processing resource 682 can provide a number of identifying functions. In various examples, the identify module 685 can identify a previous ejection waveform having a first plurality of parameters including a time interval from a final pulse of a plurality of pulses of the previous ejection waveform, as described herein. For instance, the instructions can, in some examples, include instructions to identify a total number of the plurality of pulses (e.g., two pulses) of the previous ejection waveform and to identify an amplitude associated with each of the plurality of pulses. The total number of the plurality of pulses can, for example, be in a range of from one pulse to four pulses. Pulses can be determined to be of the same waveform when, for example, by identifying pulses (e.g., fluid ejections) ejected prior to a dampening time elapsing (e.g., 35 microseconds).

In some examples, the plurality of pulses can be a result of a plurality of actuator movements of an actuator (e.g., piezoelectric actuator 228 as illustrated in FIG. 2) coupled to the ASIC. For example, the plurality of actuator movements can include double, triple, or quadruple movements, among others to control DV. Such control can result in control over a range of DVs, from example, a DV range can include a base DV and multiples of the base DV (e.g., a continuous range including DVs of 2×, 3, and 4× times the base DV, among other DVs). In some examples, the piezoelectric actuator can be a piezoelectric ceramic actuator.

A determining module 686 can include CRI that when executed by the processing resource 682 can perform a number of determining functions. The determine module 686 can include instructions to determine a second plurality of parameters based on the first plurality of parameters, where the second plurality of parameters define a current ejection waveform that accounts for oscillations caused by the previous ejection waveform. Examples of such instructions include JavaScript® instructions, among others suitable to determine the second plurality of parameters based on the first plurality of parameters The instructions can, for example, be stored in an internal or external non-transitory CRM coupled to the printing device (e.g., the printing device 310 as illustrated in FIG. 3) that can execute instructions stored in the internal or non-transitory external CRM.

In some examples, the system can include a store module 687. A storing module 687 can include CRI that when executed by the processing resource 682 can provide a number of storing functions. The store module 687 can store the first plurality of parameters and/or a corresponding second plurality of parameters in a lookup table, as described herein, in response to identification thereof. For example, a first plurality of parameters can be identified by the identify module 685 can be stored by the store module 687 in a lookup table. For example, the lookup table can be stored in a CRM. In some examples, the CRM can be included in a cloud system (e.g., a public and/or private cloud system) that can include a number of cloud resources (e.g., cloud servers).

In some examples, the store module 687 can store a plurality of current ejection waveforms and/or a first plurality of parameters for each of the plurality of current ejection waveforms. As described herein, the plurality of current ejection waveforms and/or a plurality of first parameters for each of the plurality of current ejection waveforms can be identified experimentally. Such experiments can include wet (e.g., fluid filled printhead) and/or dry (e.g., a printhead being void of fluid) experiments, among other experiments. Wet experiments can include observation of the speed and/or dimensions of fluid drops in flight, for example. Wet experiments can, for example, include observation of a location and/or a size of dots (e.g., dots associated with the fluid drops) on a given medium. Dry experiments can, for example, include observation of a mechanical motion, for instance, a mechanical motion induced in an ejection nozzle due to mechanical cross-talk, among other mechanical motions.

A user (e.g., an employee) can, for example, conduct such experimental tests. Such tests can identify plurality of current ejection waveforms and/or a second plurality of parameters by experimentally identifying those that account for (e.g., effectively account for) oscillations to generate a desired drop by identification of a previous ejection waveform (e.g., a first plurality of parameters of the previous ejection waveform). That is, sequentially testing of a plurality of previous ejection waveforms each having varying values of the first plurality of parameters can facilitate production of the lookup table (e.g., lookup table data), as described herein. The desired DV and DS may or may not be substantially the same as a previous drop. In some examples, the desired DV and DS of the desired fluid drop can be equal (e.g., substantially equal) to a DV and/or a DS of a fluid drop associated with the previous ejection waveform (e.g., a drop generated as a result of the previous ejection waveform). In some examples, the desired DV and DS of the desired fluid drop can be different than a DV and a DS of a fluid drop associated with the previous ejection waveform.

An applying module 688 can include CRI that when executed by the processing resource 682 can perform a number of applying functions. An applying module 688 applies the current ejection waveform to cause an ejection nozzle of the printhead to generate a desired fluid drop, the desired fluid drop having a desired drop volume and desired drop speed. In various examples, the desired drop can include a desired DV or a desired DS. For example, a desired fluid drop can be generated by applying the current ejection waveform (e.g., a second plurality of parameters of the current ejection waveform) to an actuator of an ejection nozzle of the printhead to generate the desired fluid drop.

The memory resource 684 can be integral, or communicatively coupled, to a computing device, in a wired and/or a wireless manner. For example, the memory resource 684 can be an internal memory, a portable memory, a portable disk, or a memory associated with another computing resource (e.g., enabling CRIs to be transferred and/or executed across a network such as the Internet).

The memory resource 684 can be in communication with the processing resource 682 via a communication path 683. The communication path 683 can be local or remote to a computing device) associated with the processing resource 682. Examples of a local communication path 683 can include an electronic bus internal to a computing device where the memory resource 684 is one of volatile, non-volatile, fixed, and/or removable storage medium in communication with the processing resource 682 via the electronic bus.

The communication path 683 can be such that the memory resource 684 is remote from the processing resource (e.g., 682), such as in a network connection between the memory resource 684 and the processing resource (e.g., 682). That is, the communication path 683 can be a network connection. Examples of such a network connection can include a local area network (LAN), wide area network (WAN), personal area network (PAN), and the Internet, among others. In such examples, the memory resource 684 can be associated with a first computing device and the processing resource 682 can be associated with a second computing device (e.g., a Java® server). For example, a processing resource 682 can be in communication with a memory resource 684, where the memory resource 684 includes a set of instructions and where the processing resource 682 is designed to carry out the set of instructions.

The processing resource 682 coupled to the memory resource 684 can execute CRI to perform various functions. CRI can be executed to identify a previous ejection waveform having a first plurality of parameters that can a time interval from a final pulse of a plurality of pulses of the previous ejection waveform and an amplitude of the each of the plurality of pulses. CRI can be executed to determine a second plurality of parameters based on the first plurality of parameters, wherein the second plurality of parameters define a current ejection waveform that accounts for oscillations caused by the previous ejection waveform. CRI can be executed to apply the current ejection waveform to cause an ejection nozzle of the printhead to generate a desired fluid drop, the desired fluid drop having a desired drop volume and desired drop speed.

Figure 7:
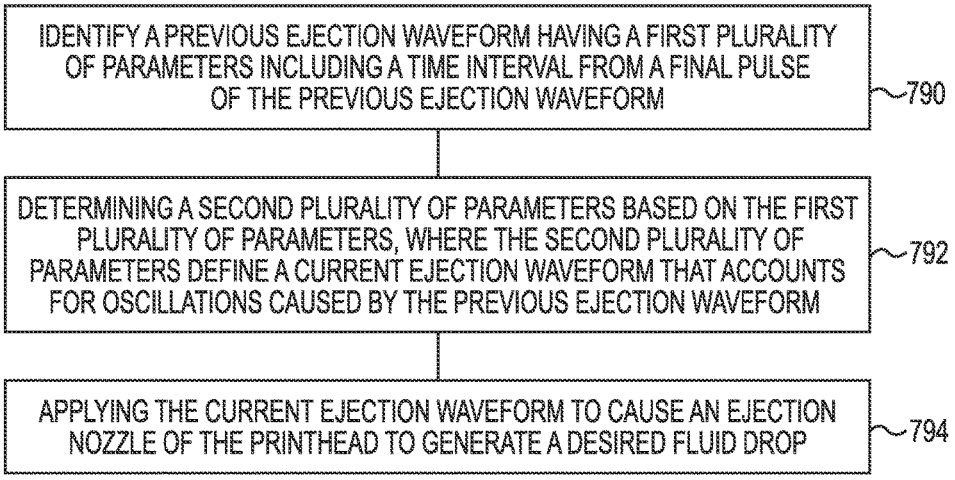
FIG. 7 illustrates a block diagram of an example of a method for modulating oscillations in printheads according to the present disclosure.

FIG. 7 illustrates a block diagram of an example of a method for simulating real user issues in support environments according to the present disclosure. As shown at 790, in various examples, the method can include identifying a previous ejection waveform having a first plurality of parameters including a time interval from a final pulse of the previous ejection waveform. That is, identifying can include executing instructions stored in memory to identify the previous ejection waveform having a first plurality of parameters including the time interval from the final pulse of the previous ejection waveform.

In some example, the method can include identifying the previous ejection waveform having a single pulse (e.g., a single pulse as the total number of pulses). However, the disclosure is not so limited. That is, the total number of the plurality of pulses can, for example, be in a range of from one pulse to four pulses, among others.

As shown at 792, in various examples, the method can include determining a second plurality of parameters based on the first plurality of parameters, where the second plurality of parameters define a current ejection waveform that accounts for oscillations caused by the previous ejection waveform. That is, determining a second plurality of parameters can include executing instructions stored in memory to determine a second plurality of parameters based on the first plurality of parameters, where the second plurality of parameters define a current ejection waveform that accounts for oscillations caused by the previous ejection waveform. In some examples, accounting for the oscillations caused by the previous ejection waveform can include accounting for oscillations that would otherwise result in a deviation from the desired drop, the desired drop. The desired drop can include a desired drop speed and/or a desired drop volume As shown at 794, in various examples, the method can include to apply the current ejection waveform to cause an ejection nozzle (e.g., of the plurality of ejection nozzles) of the printhead to generate a desired fluid drop, the desired fluid drop having a desired drop volume and desired drop speed. Applying the current ejection waveform can include executing instructions stored in memory to apply the current ejection waveform to cause an ejection nozzle of the printhead to generate a desired fluid drop. The current ejection waveform can, for example, include a second plurality of parameters that can account for oscillations caused by the previous ejection waveform. In some examples, applying the current ejection waveform to the ejection nozzle of the printhead to generate a desired fluid drop can include modulating a voltage parameter of the second plurality of parameters relative to the time interval. For example, the voltage parameter can be increased or decreased with respect to a print frequency, as described herein. In some examples, applying the current ejection waveform to the ejection nozzle of the printhead to generate a desired fluid drop can include modulating a number of the second plurality of parameters to modulate a shape of the current ejection waveform.

In some examples, accounting for the oscillations can include accounting for the oscillations caused by cross-talk from a different ejection nozzle of the printhead. In this case, cross-talk refers to oscillations experienced in response to the jetting of a different ejection nozzle of the printhead that is actuated with a known ejection waveform within a predetermined window of time that can include a time interval starting before and extending to after the affected jet (e.g., the ejection nozzle of the printhead the current ejection waveform is applied to) is fired. The cross-talk can be mechanical (e.g., pressure transmitted through a structure of the printhead) and/or fluidic (e.g., pressure transmitted through the fluid in the printhead). The window represents the period in which the jetting chamber may be vulnerable to mechanical or fluidic disturbances from its neighbors. Accounting for oscillations caused by cross-talk can include selecting a second plurality of parameters that account for such oscillations. Such a second plurality of parameters (e.g., accounting for cross-talk) can be applied, for example globally and/or individually to ejection nozzle(s), as described herein, to reduce and/or eliminate oscillations from cross-talk.

FIG. 8 illustrates a plot of an example drop speed for two example sequential, single-pulse ejection waveforms according to the present disclosure. As illustrated in FIG. 8, oscillations, as shown by impact on DS (indicated by fluctuating line) in FIG. 8, tend to dissipate (e.g., decrease in magnitude) with time. However, waiting a period of time for such dissipation may be counterproductive to achieving consumer desires, as described herein. Printing while experiencing such oscillations can translate to fluctuations in an amount of fluid output (e.g., drop volume) and/or rate of fluid output (e.g., drop speed) from fluid ejection elements (e.g., fluid ejection elements of the printhead). As illustrated in FIG. 8, an example of a time interval for an impact of the oscillations to dissipate can, for example, be 35 microseconds, among other time intervals depending upon an amplitude of the previous ejection waveform, among other factors, as described herein. While FIG. 8 illustrates that a center point of the oscillations can dip below a long time interval value for a drop (e.g., after 35 microseconds), the present disclosure is not so limited. That is, the center point of the oscillations can, in some examples, rise above the long term value for the drop speed (e.g., after 35 microseconds).

As described herein, accounting for such oscillations can be advantageous. FIG. 9 illustrates a plot of example modulation voltages for an example desired drop speed for an example time interval according to the present disclosure. That is, FIG. 9 illustrates an example amount of voltage needed at a given time interval to modulate a drive voltage (e.g., a voltage parameter of the second plurality of parameters) for a current ejection waveform having a single pulse subsequent to a previous ejection waveform having a single pulse to achieve a desired drop (e.g., a desired DS of 8.7 m/sec). In some examples, accounting can include adjusting a dip and/or a rise in a center point (e.g., adjusting a parameter of the second plurality of parameters to alter a dip and/or a rise point in the current waveform).

In some examples, accounting for such oscillations can include accounting for previous adjustments made to a previous waveform (e.g., a previous waveform modulated to account for oscillations). Such adjustment can be indentified, for example, similar to the identification functions described with respect to the identifying module 685, described herein. In some examples, such previous adjustments can impact a subsequent time interval. Accounting for previous adjustments can include accounting for such an impact on the time interval (e.g., a time interval associated with a most recent ejection waveform applied to an ejection nozzle). For example, previous adjustments to a waveform (e.g., a modulated waveform) can result in a comparatively shortened and/or lengthened a time interval with respect to a time interval from an unmodulated previous waveform. Examples of accounting for such an impact on the time interval can include introducing time advances or time delays associated with a current waveform (e.g., adjusting a time parameter of the second plurality of parameters of the current waveform) to account for the impact of the time interval from previous waveforms. Such accounting for an impact on the time interval can, in some examples, promote accounting for oscillations with drop ejection waveforms and/or promote achieving a desired printing frequency.

As illustrated in FIG. 9, the voltage parameter can be modified by a modulation voltage (as shown on the vertical-axis of FIG. 9). A value the modulation voltage can depend upon factors including the amplitude of a previous ejection waveform and/or a desired drop (e.g., a desired drop speed), among other factors, as described herein. For example, a voltage parameter of the second plurality of parameters can, in some examples, be increased or decreased in a range of from 0.01 volts to 2.00 volts. That is, the value of the modulation voltage can be in a range of from 0.01 volts to 2.00 volts, for example. However, the disclosure is not so limited. That is, a given parameter (e.g., a voltage parameter of the second plurality of parameters) can be increased and/or decreased by a suitable amount to promote accounting for oscillations in printhead with drop ejection waveforms.

Figure 10:
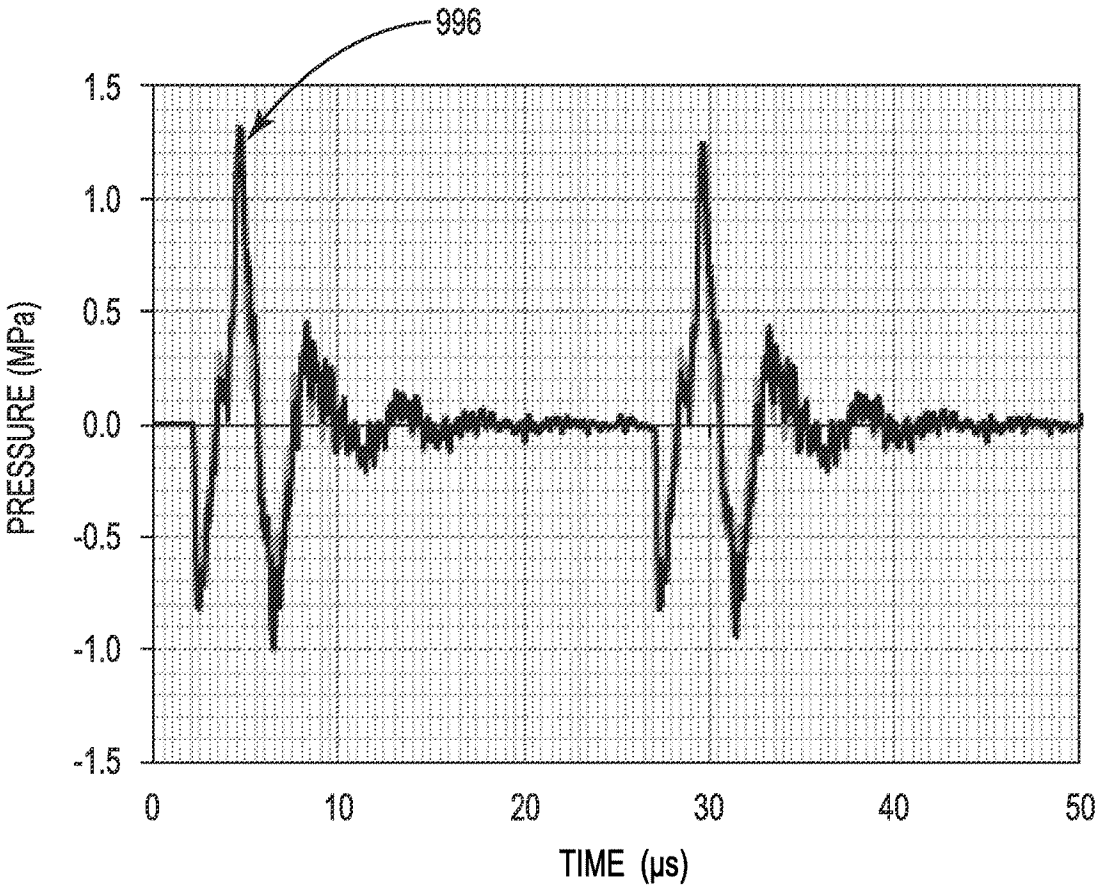
FIG. 10 illustrates a plot of example pressure fluctuations for unmodulated, sequential, single-pulse ejection waveforms according to the present disclosure
Figure 11:
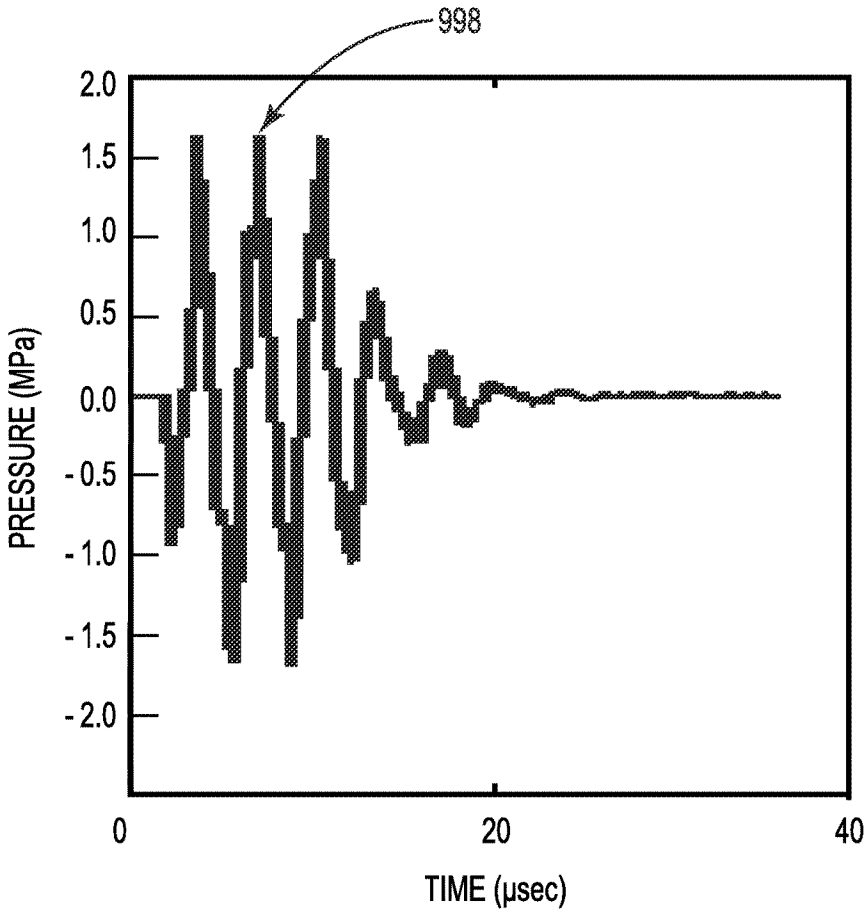
FIG. 11 illustrates a plot of example pressure fluctuations for modulated, sequential, single-pulse ejection waveforms according to the present disclosure.

Examples results of such modulation are illustrated and described with respect to FIG. 10 and FIG. 11. FIG. 10 illustrates a plot of example pressure fluctuations for unmodulated, sequential, single-pulse ejection waveforms according to the present disclosure. That is, FIG. 10 illustrates a plot of a pressure (e.g., a pressure range) inside a firing chamber during and after two sequential single-pulse ejection waveforms 996. Such a plot, can for example, be generated with a finite element mechanical model coupled to a computational fluid dynamics model. Each positive peak in the pressure causes drop ejection, as describe herein. In some examples, the ejection waveforms, for example a previous ejection waveform and a current ejection waveform can be initiated at 0 and 25 seconds. As illustrated in FIG. 10, a second positive pressure peak corresponding to a second ejection waveform can be slightly smaller than the first pressure peak due to the first ejection waveform. That is, oscillations (e.g., residual pressure fluctuations) can, for example, reduce a magnitude of the pressure to the second ejection waveform. For instance, the residual pressure fluctuations from the first drop ejection can remain in a firing chamber and can add (e.g., interfere) with the pressure from the second ejection waveform (e.g., a second unmodulated ejection waveform).

In contrast, FIG. 11 illustrates a plot of example pressure fluctuations for modulated, sequential, single-pulse ejection waveforms according to the present disclosure. FIG. 11 illustrates a pressure inside the firing chamber during and after three successive modulated single-pulse ejection waveforms 998. Such a plot can be generated with a finite element mechanical model coupled to a computational fluid dynamics model. Similar to FIG. 10, each of the first three positive peaks illustrated in FIG. 11 can cause drop ejection. As shown in FIG. 11, the three ejection waveforms can be initiated at 2 μsec, 5.3 μsec, and 8.6 μsec. The second and third ejection waveforms can each be defined by a plurality of parameters that accounts for oscillations caused by the previous ejection waveform (e.g., the first and second ejection waveforms, respectively). That is, the peaks of the second and third ejection waveforms have a uniform value (e.g., a value of approximately 1.5 megaPascals (MPA) where 1 MPa is approximately equal to 9.87 atmospheres) as illustrated in FIG. 11. Such uniformity can be achieved by applying a modulation voltage, such as those described herein (e.g., described with respect to FIG. 9). As a result, the second and the third pressures for the second and third ejection waveforms each add with respective residual pressure fluctuations such that the first three positive pressure peaks are equal resulting in ejection of three identical drops (e.g., three desired drops). However, the disclosure is not so limited. That is, the present disclosure can include a suitable number of ejection waveforms, time interval between each of the number of ejection waveform, and/or a suitable number of pulses of each of the number of ejection waveform, among others, can be varied to promote accounting for oscillations with drop ejection waveforms.

The specification examples provide a description of the applications and use of the system and method of the present disclosure. Since many examples can be made without departing from the spirit and scope of the system and method of the present disclosure, this specification sets forth some of the many possible example configurations and implementations.

What is claimed:

1. A method to control a printhead, comprising:

identifying a previous ejection waveform having a first plurality of parameters including a time interval from a final pulse of the previous ejection waveform;

determining a second plurality of parameters based on the first plurality of parameters, wherein the second plurality of parameters define a current ejection waveform that accounts for oscillations caused by the previous complex ejection waveform, and determining the second plurality of parameters comprises accounting for oscillations of different ejection nozzles of the printhead; and applying the current ejection waveform to cause an ejection nozzle of the printhead to generate a desired fluid drop by modulating a drop speed while maintaining a drop volume constant, wherein application of the current ejection waveform superposes oscillations caused thereby with the oscillations caused by the previous ejection waveform.

2. The method of claim 1, wherein the oscillations caused by the previous complex ejection waveform includes oscillations that would otherwise result in a deviation from the desired fluid drop, the desired drop having a desired drop volume.

3. The method of claim 1, wherein the oscillations caused by the previous ejection complex waveform includes oscillations caused by cross-talk from a different ejection nozzle of the printhead.

4. The method of claim 1, wherein the method includes modulating a voltage parameter of the second plurality of parameters relative to the time interval.

5. The method of claim 1, wherein the method includes modulating a number of the second plurality of parameters to modulate a shape of the current complex ejection waveform.

6. The method of claim 1, wherein identifying includes identifying the previous complex ejection waveform having a single pulse.

7. The method of claim 1, wherein said first plurality of parameters includes a pulse width parameter.

8. The method of claim 1, herein determining said second plurality of parameters comprises adjusting a given parameter of the second plurality of parameters based on a time interval between each pulse of the previous ejection waveform.

9. The method of claim 1, wherein the current ejection waveform accounts for adjustments made to the previous ejection waveform.

10. The method of claim 1, wherein the current ejection waveform has a positive pressure peak that is smaller than a pressure peak in the previous ejection waveform.

11. A drive circuit including logic, embedded in an application specific integrated circuit (ASIC) to control a printhead, the drive circuit to:

identify a previous ejection waveform having a first plurality of parameters including a time interval from a final pulse of a plurality of pulses of the previous ejection waveform and an amplitude of the each of the plurality of pulses;

determine a second plurality of parameters based on the first plurality of parameters, wherein the second plurality of parameters define a current ejection waveform that accounts for oscillations caused by the previous ejection waveform by scaling at least one of the first plurality of parameters, and the drive circuit to determine the second plurality of parameters comprises the drive circuit to account for oscillations of different ejection nozzles of the printhead; and apply the current ejection waveform to cause an ejection nozzle of the printhead to generate a desired fluid drop by modulating a drop speed while maintaining a drop volume constant.

12. The drive circuit of claim 11, wherein the plurality of pulses are a result of a plurality of actuator movements of an actuator coupled to the ASIC, the plurality of actuator movements including double, triple, or quadruple actuator movements.

13. The drive circuit of claim 12, wherein the second plurality of parameters are superposed on trimming compensation.

14. The drive circuit of claim 11, wherein the time interval includes a time interval from the end of the final pulse of the previous ejection waveform to initiation of a first pulse of the current ejection waveform.

15. The drive circuit of claim 11, wherein the desired drop volume and the desired drop speed of the desired fluid drop are different than a drop volume and a drop speed of a fluid drop associated with the previous ejection waveform.

16. The drive circuit of claim 11, wherein identifying the previous ejection waveform having a first plurality of parameters comprises approximating a given identified value of a given parameter to an approximated value.

17. A system to control a printhead, the system comprising a processing resource in communication with a memory resource, the memory resource including instructions and the processing resource designed to carry out the instructions, the instructions executable to:

identify a previous ejection waveform having a first plurality of parameters including a time interval from a final pulse of a plurality of pulses of the previous ejection waveform;

determine a second plurality of parameters based on the first plurality of parameters and a desired drop speed, wherein the second plurality of parameters define a current ejection waveform that accounts for oscillations caused by the previous ejection waveform, wherein:

the second plurality of parameters comprises a time interval between a final pulse of the previous ejection waveform to initiation of a first pulse of the current ejection waveform;

the second plurality of parameters comprises a time between pulses of the current ejection waveform, and determining the second plurality of parameters comprises:

determining a different time interval between pulses of the current ejection waveform as compared to a time interval between pulses of the previous ejection waveform;

determining a different number of pulses of the current ejection waveform as compared to a number of pulses of the previous ejection waveform; and accounting for oscillations of different ejection nozzles of the printhead;

store the first plurality of parameters and the second plurality of parameters in a lookup table in response to identification thereof; and apply the current ejection waveform to cause an ejection nozzle of the printhead to generate a desired fluid drop by modulating a drop speed while maintaining a drop volume constant.

18. The system of claim 17, wherein the instructions to identify include instructions executable to identify a total number of the plurality of pulses of the previous ejection waveform and to identify an amplitude associated with each of the plurality of pulses.

19. The system of claim 17, wherein the instructions to apply include instructions executable to apply the current ejection waveform globally to a plurality of ejection nozzles of the printhead to cause the plurality of ejection nozzles to generate a plurality of the desired fluid drops.

20. The system of claim 17, wherein the instructions to apply include instructions executable to apply the current ejection waveform individually to an ejection nozzle of a plurality of ejection nozzles of the printhead to cause the ejection nozzle to generate the desired fluid drop.

* * * * *